US005427298A

United States Patent [19]

Tegtmeier

[11] Patent Number: 5,427,298

[45] Date of Patent: Jun. 27, 1995

[54] METHOD AND APPARATUS FOR INDICATING QUANTITY OF FASTENERS IN A FASTENING DEVICE

[76] Inventor: C. Allen Tegtmeier, 850 Seventeen Mile Dr., Pacific Grove, Calif. 93950

[21] Appl. No.: 144,281

[22] Filed: Oct. 28, 1993

[51] Int. Cl.[6] ..... B25C 5/16

[52] U.S. Cl. ..... 227/120; 173/20

[58] Field of Search ..... 227/120, 156, 127; 173/1, 20

[56] References Cited

U.S. PATENT DOCUMENTS

| | | | |
|---|---|---|---|
| 2,227,826 | 1/1941 | Drypolcher et al. | 227/127 |
| 2,973,519 | 3/1961 | Jopp | 227/128 |
| 4,179,057 | 12/1979 | Becht et al. | 227/120 |
| 4,506,819 | 3/1985 | Rand | 227/120 |
| 4,591,086 | 5/1986 | Campbell et al. | 227/114 |
| 4,801,062 | 1/1989 | Austin | 227/120 |
| 4,925,082 | 5/1990 | Kim | 227/120 |

*Primary Examiner*—Scott A. Smith

*Attorney, Agent, or Firm*—LaRiviere, Grubman & Payne

[57] ABSTRACT

Method and apparatus for immediately measuring the amount of fasteners remaining in a fastening device's magazine by inspection without disassembly of the fastening device. A band fastened to the fastening device's magazine follower moves responsive to the motion of the magazine follower. Markings on the band indicate the amount of fasteners remaining in the fastening device.

18 Claims, 3 Drawing Sheets

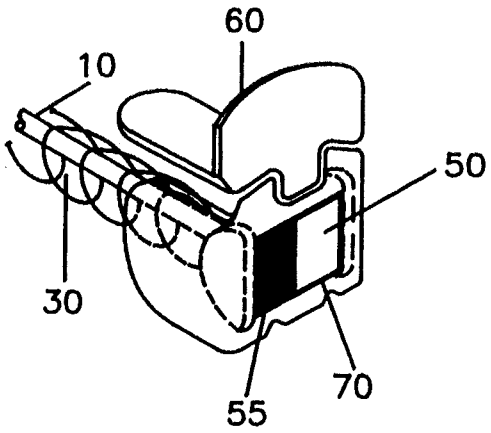
FIG. 2
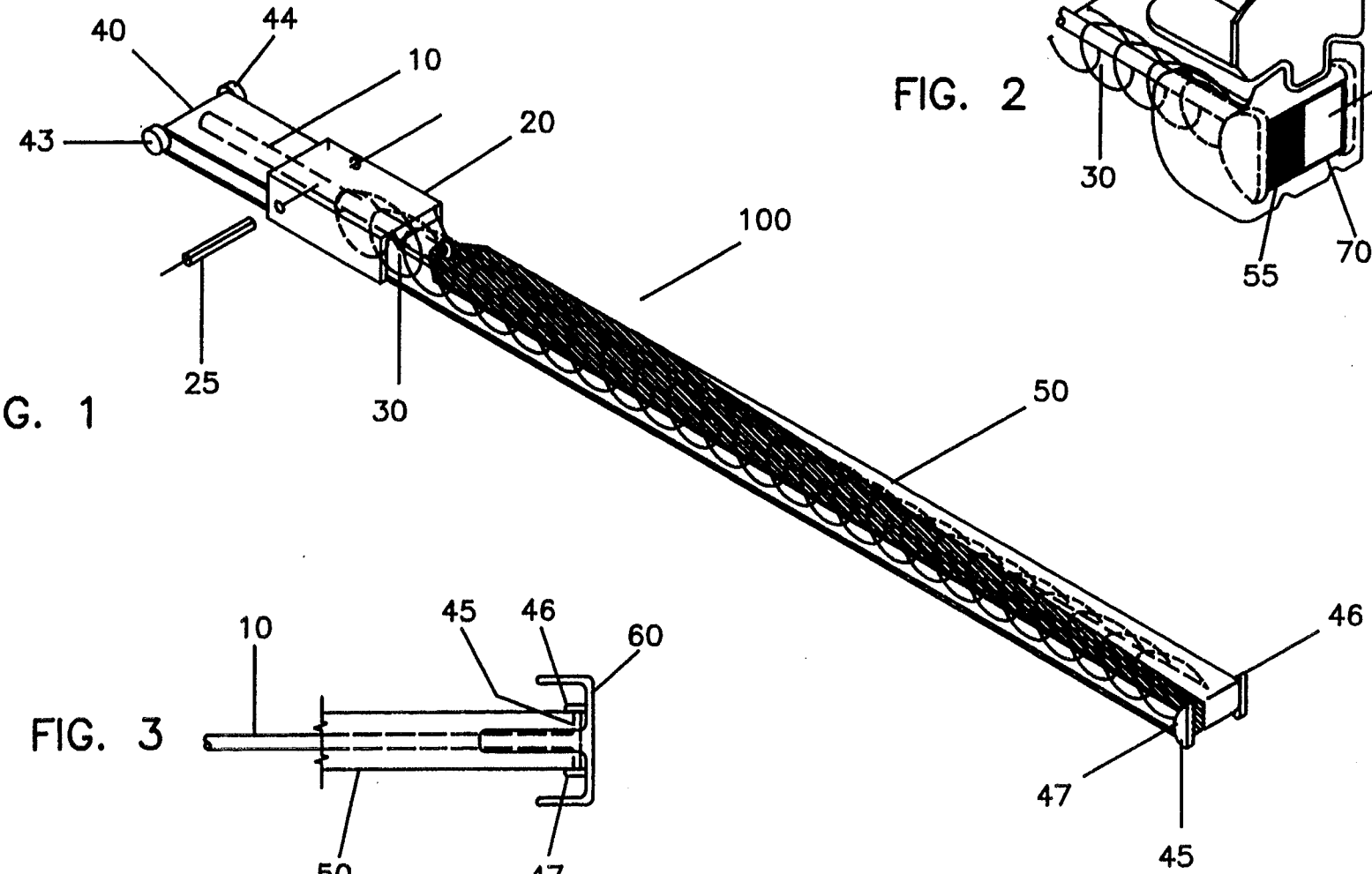
FIG. 1
FIG. 3

METHOD AND APPARATUS FOR INDICATING QUANTITY OF FASTENERS IN A FASTENING DEVICE

TECHNICAL FIELD

The present invention relates to magazine-fed fastening devices. More specifically, the present invention relates to magazine-fed staplers and staple guns which use a magazine follower apparatus.

BACKGROUND ART

Fastening devices, such as staplers, staple, brad, nail and connector guns are commonly used in the home, in offices, industry and construction. A feature common to most fastening devices using fasteners which are supplied in a frangible stick, e.g., staples or brads, is the use of a spring-biased magazine follower to push the stick of fasteners forward in the magazine towards the operating end of the fastening device. This has the effect of feeding the fasteners sequentially and continuously into the operating end of the fastening device, and maintaining the first fastener, i.e., the next fastener to be dispensed, in proper position for dispensing. Magazine, as used in this application, denotes a receptacle for receiving therein a quantity of fasteners, and which stores and sequentially dispenses these fasteners as the fastening device is actuated. Magazines in current use in fastening devices are either integral with the fastening devices or removable therefrom. The spring-biased magazine follower common to these fastening devices may be integral with the magazine, integral with the fastening device or removable from either or both. A common feature of many of these fastening devices is the mounting of the magazine follower on a follower rod, upon which the magazine follower is slidably mounted. Many of these fastening devices utilize a removable magazine follower assembly which comprises the magazine follower, follower rod, bias spring and closure device. The closure device typically has mounted on it the follower rod, and serves to close the magazine and hold the fasteners therein. The bias spring is also mounted on the follower rod, between the magazine follower and the closure device. A failing of many of these fastening devices is that there is no convenient means for measuring the amount of fasteners remaining in the magazine without some disassembly of the device. Often, the only means available to determine the quantity of fasteners remaining in the device is to manually remove the fasteners from the device, or at least to open the device for visual inspection. In an office environment, running out of staples in the midst of a project is a minor annoyance. On a construction site however, when a construction worker may for reasons of distance or ease of access lack ready availability to his source of fasteners, knowing how many fasteners remain in the fastening device may enable a worker to realize significant savings in labor expended. Having to stop work in order to open the fastening device and visually inspect the fastener quantity is inefficient, and given the conditions on some construction sites, may be potentially dangerous.

A system utilized in some fastening systems is the use of open-sided magazines for displaying directly the amount of fasteners remaining in the device. While this methodology is often seen in nail guns, it is seldom found in staplers, staple guns, brad guns and the like used for installing a wide variety of patent fasteners and connectors. The magazine follower is an accurate indicator of the quantity of fasteners remaining in the fastening device. If some means could be found for showing the position of the magazine follower in the magazine without disassembly of the fastening device, the quantity of fasteners contained therein could be established by immediate external visual inspection.

What is needed is a method or apparatus for measuring the quantity of fasteners contained in the magazine of a fastening device without disassembling the fastening device and indicating, at a glance, that quantity to the user. This method or apparatus could use the position of the magazine follower to drive an indicator means for indicating the quantity of fasteners in the fastening device. In fastening devices with removable magazine follower assemblies, the apparatus should be capable of being effected without re-designing or retooling the existing fastening device. Where the fastening device lacks a removable magazine follower assembly, the principles of the present invention should be employable without extensive modification of the existing design.

DISCLOSURE OF INVENTION

An apparatus constructed according to the present invention for measuring and indicating the amount of fasteners remaining in the magazine of a fastening device comprises a magazine follower biased towards the operating end of the fastening device by a spring or other bias means. The bias means causes the magazine follower to contact the last fastener in a stick of fasteners and bias or position the fasteners sequentially under the operating end as each successive fastener is dispensed. This spring is typically a coiled helical compression spring, but could also comprise a tension spring, pneumatic cylinder, hydraulic cylinder, hydropneumatic cylinder or other suitable means for biasing the magazine follower towards the operating end of the fastening device. In many fastening devices, the magazine follower is slidably mounted on a follower rod. This follower rod is typically maintained in coaxial alignment with and within the magazine, the rod then having substantially forward and substantially rearward ends. The present invention teaches guide rollers installed at both the front end of the fastening device's magazine (i.e., the end toward the operating end of the fastening device) and the back end of the magazine. The guide rollers receive, align and route a flexible band which is affixed at both ends to the magazine follower, thereby forming a substantially continuous loop around the guide rollers. This loop is formed over the follower rod, if such a rod is installed in the fastening device. The guide rollers are positioned substantially parallel to the axis of the magazine, and maintain the band in linear alignment with the magazine and the fasteners contained therein. This flexible band forms a linear measuring device for measuring the quantity of fasteners in the magazine. Where the fastening device comprises a follower rod, the front and rear guide rollers can be mounted on the front and rear of the rod respectively. The guide rollers could be flanged rollers, non-flanged rollers mounted between rigid guide flanges or curved sections which serve the purposes of receiving and directing the band. As the magazine follower slides up and down in the magazine, responsive to contact with the stick of fasteners, the motion of the magazine follower is transmitted to the band. An aperture is formed at some location on or about the magazine area of the fastening device for viewing a segment of the band. As the band moves responsive to the motion of the magazine follower, that portion of the band visible in the aperture indicates, by the markings thereon, the amount of fasteners remaining in the magazine. Markings may be formed in any manner which will adequately display the amount of fasteners in the device, for instance as a contrasting band of color diagonally disposed on the band, or as numbers or fractions printed thereon. While a band is referred to herein, the present invention specifically contemplates the use of other flexible linear indicator materials such as wire, twine, fabric ribbon, chain, braid, flexible metallic tape or the like in performing the indicator function of the present invention.

Where the particular fastening device contemplated for use with present invention comprises a removable magazine follower assembly, having a closure apparatus integral therewith, the present invention includes such a closure device modified by having an aperture formed therein for viewing the indicator band.

According to the present invention, the magazine follower provides two attachment points for the band: each end of the band being attached to the magazine follower. Various attachment methods are contemplated by the present invention including hooks, chemical adhesives, rivets, bolts, clamps or other mechanical clamping methods. Also contemplated by the present invention is the use of hook and loop tape, snaps, stitching or other fabric attachment means for securing the band to the magazine follower. In one example of a mechanical fastening means, one end of the magazine follower of the present invention has a hook formed thereon for accepting hole formed at one end of the band. At the other end of magazine follower, a pair of holes have been formed for accepting therein a pin. A pin, rivet or the like is inserted through the hole, through a loop formed in the other end of the band, and the other hole in the magazine follower, thereby securing the other end of band to the other end of magazine follower. The band is formed of flexible material capable of being imprinted with markings, and in the case where the fasteners are staples, is sized to fit between the legs of the stick of staples in the magazine. The band may be slightly elastic in order to maintain its own tension as it moves around guide rollers. Alternatively, the band could be maintained in tension around the guide rollers by the use of a band tension means such as a coiled helical take-up spring, rubber band, elastic or the like.

The apparatus of the present invention is used in the magazine of a fastening device. Where the magazine follower assembly is separately removable from the fastening device, the apparatus of the present invention may be removable with the magazine follower assembly. Where the magazine follower is not a removable assembly, the apparatus of the present invention remains within the fastening device. The magazine follower contacts the terminal fastener in a stick of fasteners. The magazine follower slides rearward in the magazine, responsive to the magazine follower being maintained in a given position by the stick of fasteners. In moving rearward the magazine follower compresses the bias spring, thereby maintaining forward pressure on the stick of fasteners. This forward pressure ensures that the first fastener in the stick of fasteners is maintained in alignment in the operative end of the fastening system and a new fastener is fed into, and likewise maintained in, alignment as each preceding fastener is expended.

While the preceding feeding and alignment functions of similar devices are well known in the art, it is a particular feature of the present invention that as the magazine follower moves in the magazine, either forward or backward, an indicator band moves responsive to the motion of the magazine follower. By displaying a portion of this band through the aperture, the band having on it markings, the amount of fasteners remaining in the fastening device's magazine is immediately determinable by inspection without disassembly of the fastening device.

Other features of the present invention are disclosed or apparent in the section entitled "BEST MODE OF CARRYING OUT THE INVENTION".

BRIEF DESCRIPTION OF THE DRAWINGS

For fuller understanding of the present invention, reference is made to the accompanying drawing in the following detailed description of the Best Mode of Carrying Out the Invention. In the drawing:

FIG. 1 is an oblique rear perspective of an apparatus constructed according to the present invention, where the fastening device comprises a magazine follower slidably mounted on a follower rod.

FIG. 2 is an oblique rear perspective of a closure means for a fastening device mounted on a follower rod and incorporating the present invention (bias means removed for clarity).

FIG. 3 is a top view of a closure means for a fastening device mounted on a follower rod and incorporating the present invention (bias means removed for clarity).

Figure 4:
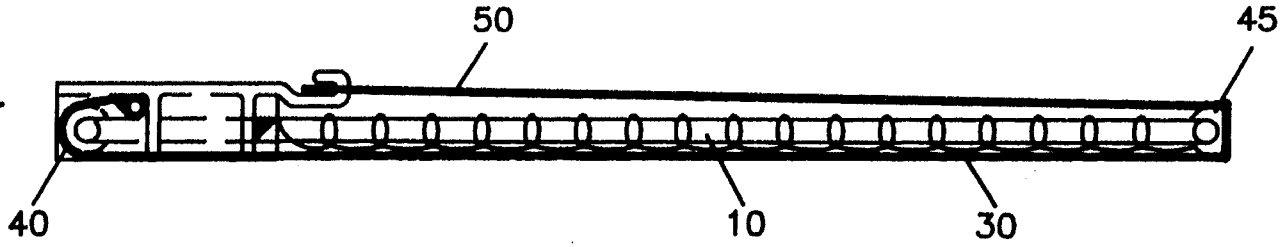
FIG. 4 is side view of one embodiment of the present invention, showing the routing of the linear indicator band around the front and rear guides.

Reference numbers refer to the same or equivalent parts of the invention throughout the several figures of the drawing.

BEST MODE OF CARRYING OUT THE INVENTION

Referring now to FIG. 1, a fastener magazine indicator apparatus constructed according to the present invention is shown. Indicator apparatus 100 consists of follower rod 10, having slidably mounted upon it magazine follower 20. Magazine follower 20 is biased towards an operating end of the fastening device by spring 30. As magazine follower 20 is biased towards the operating end of the fastening device, it contacts the last fastener in a stick of fasteners (not shown), positioning the fasteners sequentially into the operating end. Follower rod 10 has rotatably mounted at the front end (i.e., the end toward the operating end of the fastening device) front guide roller 40 and at the rear end, rear guide 45. The guide and guide roller are flanged to accept between the flanges flexible band 50. Front guide flanges are shown at 43 and 44, and rear guide flanges are shown at 46 and 47. Band 50 is affixed at both ends to magazine follower 20, thereby forming a substantially continuous loop. As magazine follower 20 slides up and down follower rod 10, the motion of band 50 corresponds to the motion of magazine follower 20.

A closure means 60 for a specific fastening device modified according to the present invention is shown at :FIG. 2. Aperture 70 is formed in closure means 60 for viewing band 50. Markings 55 on band 50 indicate the quantity of fasteners in the fastening device.

The routing of band 50 (top section cut away in this view) around rear guide roller 45 is shown in FIG. 3.

The routing of band 50 around front guide roller 40 and rear guide 45 is shown in FIG. 4.

Figure 5:
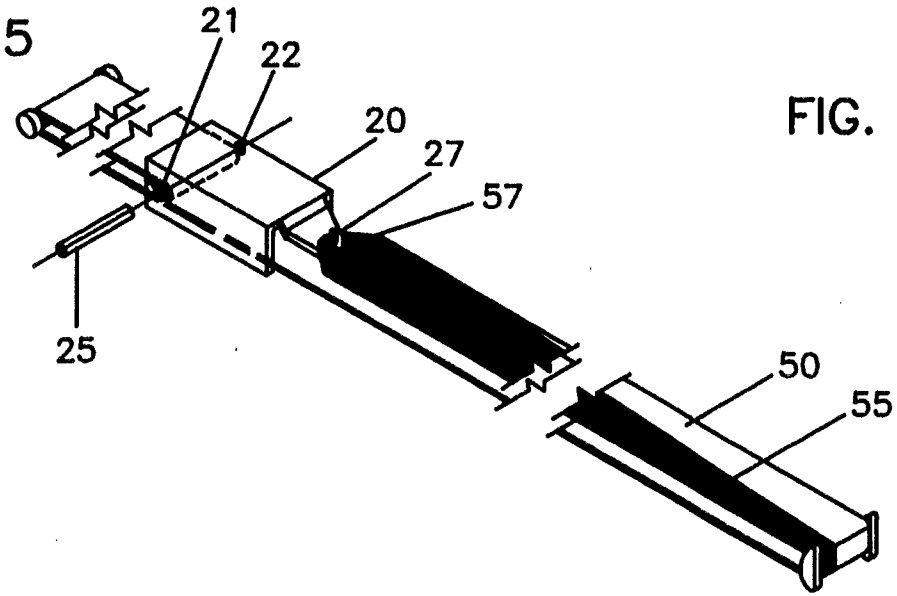
FIG. 5 is side view of one embodiment of the present invention, showing the attachment of the indicator band to the magazine follower, and the routing of the linear indicator band around the front and rear guides (bias means removed for clarity).
Figure 9:
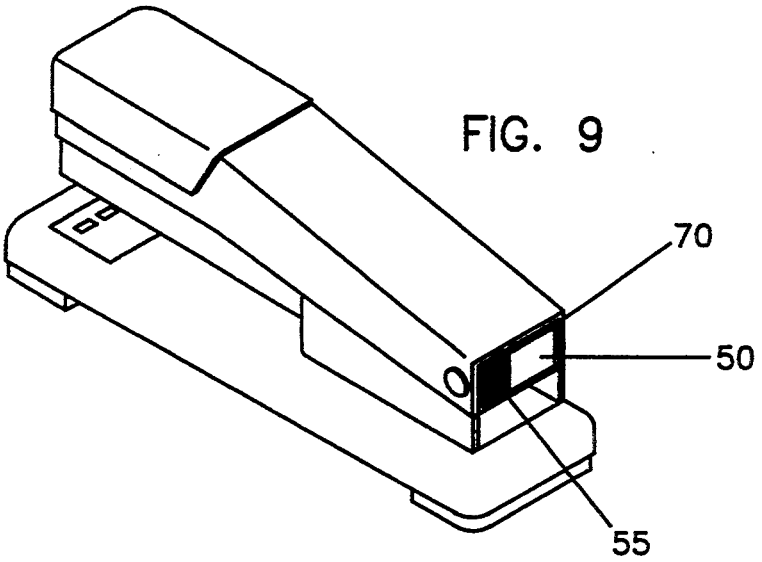
FIG. 9 is a rear oblique view of an office stapler incorporating the method of the present invention.
Figure 10:
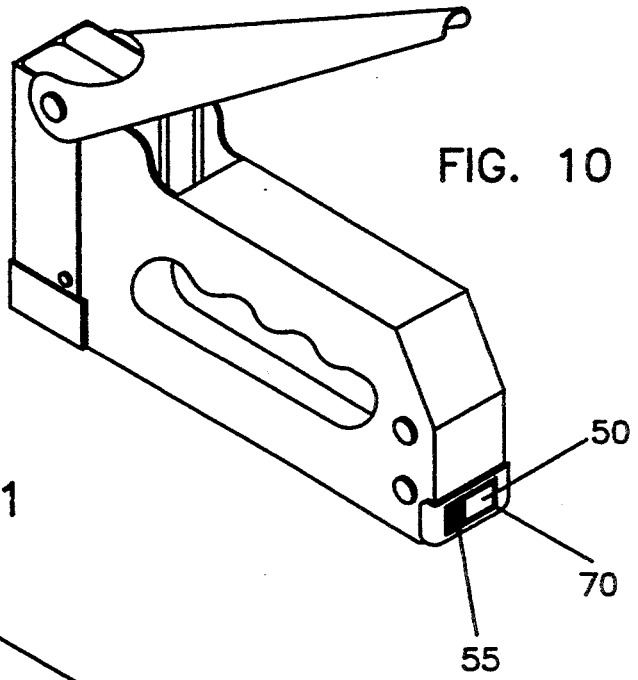
FIG. 10 is a rear oblique view of a staple gun incorporating the method of the present invention.
Figure 11:
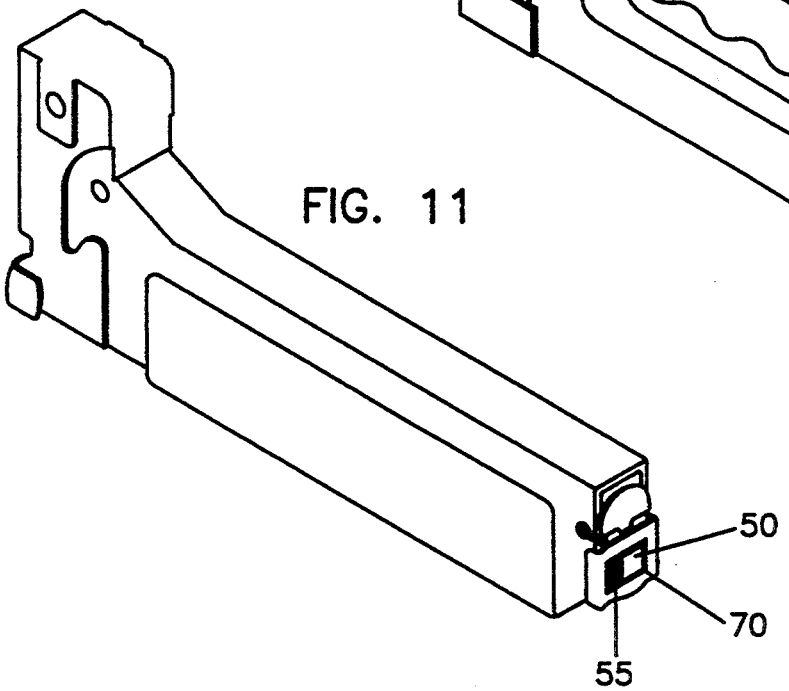
FIG. 11 is a rear oblique view of a hammer stapler incorporating the method of the present invention.

Magazine follower 20 for a fastening device according to the present invention which provides attachment points for band 50 is shown in FIG. 5. At one end of magazine follower 20, hook 27 has been formed for accepting thereon hole 57 formed at one end of band 50. At the other end of magazine follower 20, a pair of holes 21 and 22 have been formed for accepting therein pin 25. Pin 25 is inserted through hole 21, loop 52 formed in the other end of band 50, and hole 22, thereby securing the other end of band 50 to the other end of magazine follower 20. Band 50 is formed of flexible material capable of being imprinted with markings 55. Ideally, band 50 is slightly elastic in order to maintain it's own tension as it moves around guide roller 40 guide 45. Alternatively, band 50 can be kept in tension by means of a take-up spring inserted between one end of the band and the magazine follower.

Figure 6:
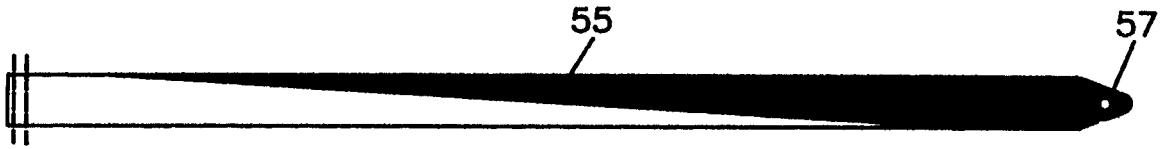
FIG. 6 is a plan view of the linear indicator band of the present invention.

Markings 55 and hole 57 of band 50 are shown in FIG. 6. Markings 55 are formed as a contrasting band of color diagonally disposed on band 50. As band 50 moves corresponding to motion of magazine follower 20, the portion of band 50 visible in aperture 70 indicates, by relative size of the markings 55, the amount of fasteners remaining in the magazine.

Figure 7:
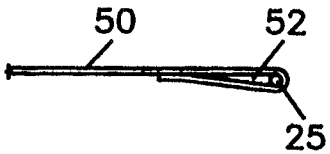
FIG. 7 is a side view of one means of attaching the front end of the linear indicator band to the magazine follower.

Loop 52, formed in one end of band 50 is shown in FIG. 7. Loop 52 is shown with pin 25 positioned therein.

Figure 8:
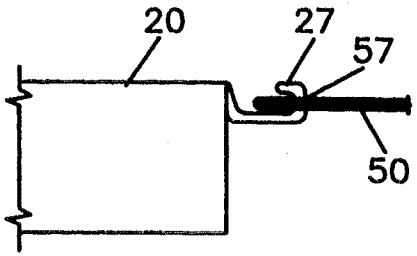
FIG. 8 is a side view of one means of attaching the rear end of the linear indicator band to the magazine follower.

Hook 27, formed at another end of magazine follower 22, is shown in FIG. 8. Hook 27 is shown engaging hole 57 of band 50.

In use, apparatus 100 of the present invention is inserted into a magazine of a fastening device. Magazine follower 20 contacts the terminal fastener in a stick of fasteners. As insertion continues, magazine follower 20 slides rearward on follower rod 10. In moving rearward magazine follower 20 compresses bias spring 30, thereby maintaining pressure on the stick of fasteners. This pressure ensures that the first fastener in the stick of Fasteners is maintained in alignment in the operative end of the fastening system and a new fastener is fed into a likewise maintained in alignment as each preceding fastener is expended. The preceding feeding and alignment functions of similar devices are well known in the art. The point of novelty of the present invention however, is that as magazine follower 20 moves along follower rod 10, band 50 moves responsive to the motion of magazine follower 20 thereby displaying, by means of markings 55 visible through aperture 70, the amount of fasteners remaining in the fastening device's magazine.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. The invention disclosed herein may be practiced without any element which is not specifically disclosed herein.

What is claimed is:

1. Fastener quantity indicator apparatus for indicating the quantity of fasteners remaining in a magazine of a fastening device while ensuring continuous feeding of said fasteners, the fastening device including magazine follower means, slidably installed in said fastening device, for contacting a terminal fastener in a stick of said fasteners and a magazine follower bias means for biasing said magazine follower means against said terminal fastener in said stick of said fasteners and towards an operative end of said fastening device, said fastener quantity indicator apparatus comprising:

linear measure means for measuring said quantity of said fasteners in said magazine, said linear measure means having a first end attached to a first attachment point formed on said magazine follower means;

rear guide means for guiding said linear measure means around a substantially rearward portion of said magazine follower bias means;

front guide means for guiding said linear measure means around a substantially forward portion of said magazine follower bias means;

said linear measure means disposed about said rear guide means and said front guide means and having a second end likewise attached to a second attachment point formed on said magazine follower means; and linear measure viewing means for viewing said linear measure means.

2. The apparatus of claim 1 wherein said linear measure means further comprises a flexible band having markings suitably disposed thereon for measuring said quantity of said fasteners in said magazine.

3. The apparatus of claim 1 wherein said first end of said flexible band is attached to said magazine follower means by hook means formed at said first attachment point and said second end of said flexible band is attached to said magazine follower means by anchor means formed at said second attachment point, said flexible band thereby forming a substantially continuous loop.

4. The apparatus of claim 2 wherein said front guide means further comprises roller means suitably disposed in said fastening device for rollably receiving, aligning and routing said flexible band, said roller means having an axis parallel to an axis of said rear guide means and perpendicular to an axis of said magazine of said fastening device.

5. The apparatus of claim 4, said roller means further comprising paired flanges for receiving therebetween said flexible band and for maintaining said flexible band in linear alignment with said fasteners and said magazine.

6. The apparatus of claim 2 wherein said rear guide means further comprises roller means for rollably receiving, aligning and routing said flexible band, said roller means having an axis parallel to an axis of said front guide means and perpendicular to an axis of said magazine of said fastening device.

7. The apparatus of claim 6, said roller means further comprising paired flanges for receiving therebetween said flexible band and for maintaining said flexible band in linear alignment with said fasteners and said magazine.

8. The apparatus of claim 1 wherein said magazine follower bias means further comprises a coiled compressive spring.

9. The apparatus of claim 1 wherein said linear measure viewing means further comprises said magazine of said fastening device having an aperture formed therein for viewing said linear measure means.

10. The apparatus of claim 1 wherein said magazine follower is slidably mounted on a magazine follower rod installed in said magazine, said apparatus further comprising:

said front guide means mounted on a substantially forward portion of said follower rod;

said rear guide means mounted on a substantially rearward portion of said follower rod; and said linear measure means forming said substantial loop around said front guide means, said rear guide means, and about said follower rod.

11. The apparatus of claim 10 wherein said follower rod is mounted on a closure means for operable insertion into said fastening device and for closing said magazine.

12. The apparatus of claim 1 wherein said fasteners further comprise substantially U-shaped staples, and said linear measure means is further formed to fit between the legs of said U-shaped staples in said stick of U-shaped staples.

13. Method for indicating the quantity of fasteners remaining in a magazine of a fastening device while ensuring continuous feeding of said fasteners without removing a fastener bias means from said fastening device, said fastener bias means including magazine follower means, slidably installed in said fastening device for contacting a terminal fastener in a stick of said fasteners and a magazine follower bias means for biasing said magazine follower means against said terminal fastener in said stick of said fasteners and towards an operative end of said fastening device, said method comprising the steps of:

attaching a first end of a linear measure means to a first attachment point formed on said magazine follower means;

guiding said linear measure means around a substantially rearward portion of said magazine follower bias means using a rear guide means;

guiding said linear measure means around a substantially forward portion of said magazine follower bias means using a front guide means;

attaching a second end of said linear measure means to a second attachment point formed on said magazine follower means, said linear measure means thereby being disposed about said rear guide means and said front guide means;

measuring the quantity of said fasteners in said magazine using said linear measure means, responsive to operation of said fastener bias means; and viewing said linear measure means using a linear measure viewing means.

14. The method of claim 13 further comprising the step of suitably disposing fastener quantity markings on said linear measure means, said linear measure means further comprising a flexible band.

15. The method of claim 14 further comprising the steps of rollably receiving, aligning and routing said flexible band around said front guide means, said front guide means including a first roller means suitably disposed upon said magazine closure means and having an axis parallel to an axis of said rear guide means and perpendicular to an axis of said magazine.

16. The method of claim 15 further comprising the steps of:

receiving said flexible band between paired flanges suitably disposed upon said first roller means; and maintaining said band in linear alignment with said fasteners and said magazine.

17. The method of claim 13 further comprising the steps of rollably receiving, aligning and routing said flexible band around said rear guide means, said rear guide means including a second roller means suitably disposed upon said magazine closure means and having an axis parallel to an axis of said front guide means and perpendicular to an axis of said magazine.

18. The method of claim 17 further comprising the steps of:

receiving said flexible band between paired flanges suitably disposed upon said second roller means; and maintaining said band in linear alignment with said fasteners and said magazine.

* * * * *